US005881619A

United States Patent [19]

Fregien et al.

[11] Patent Number: 5,881,619

[45] Date of Patent: Mar. 16, 1999

[54] METHOD AND APPARATUS FOR CUTTING BLOCKS OF SOLID ENERGETIC MATERIALS

[75] Inventors: James A. Fregien; Earl J. Shanabrook, both of San Jose, Calif.

[73] Assignee: United Technologies Corporation, Hartford, Conn.

[21] Appl. No.: 80,890

[22] Filed: Jun. 22, 1993

[51] Int. Cl.[6] ..... B26D 7/06

[52] U.S. Cl. ..... 83/13; 83/417; 83/435.17; 83/437.2; 83/857; 83/858; 83/929

[58] Field of Search ..... 83/39, 409.1, 410.7, 83/412, 417, 437, 856, 857, 858, 929, 410.8, 410.9, 418, 733, 13, 437.2, 435.17; 414/223, 744.1, 744.2

[56] References Cited

U.S. PATENT DOCUMENTS

| | | | |
|---|---|---|---|
| 3,217,768 | 11/1965 | Lamb | 83/858 X |
| 3,404,591 | 10/1968 | Nix | 83/412 X |
| 4,020,723 | 5/1977 | Nix | 83/437 X |
| 4,051,757 | 10/1977 | Reifenhauser et al. | 83/437 X |
| 4,160,314 | 7/1979 | Fridy | 29/558 |
| 4,342,242 | 8/1982 | Schaum | 83/437 |
| 4,420,997 | 12/1983 | Whitehouse | 83/411.1 X |
| 4,483,226 | 11/1984 | Costarelli | 83/437 X |
| 5,386,318 | 1/1995 | Kuhnert et al. | 414/223 X |

*Primary Examiner*—Eugenia A. Jones

[57] ABSTRACT

A remotely controlled apparatus for reducing the size of energetic materials is disclosed. The apparatus comprises a remotely controlled cutter, retainer and a device for positioning the energetic material to be reduced. Also disclosed is a method for reducing the size of energetic materials by positioning a block of energetic material between the cutter and the retainer and causing the cutter to cut through the block of energetic material.

5 Claims, 1 Drawing Sheet

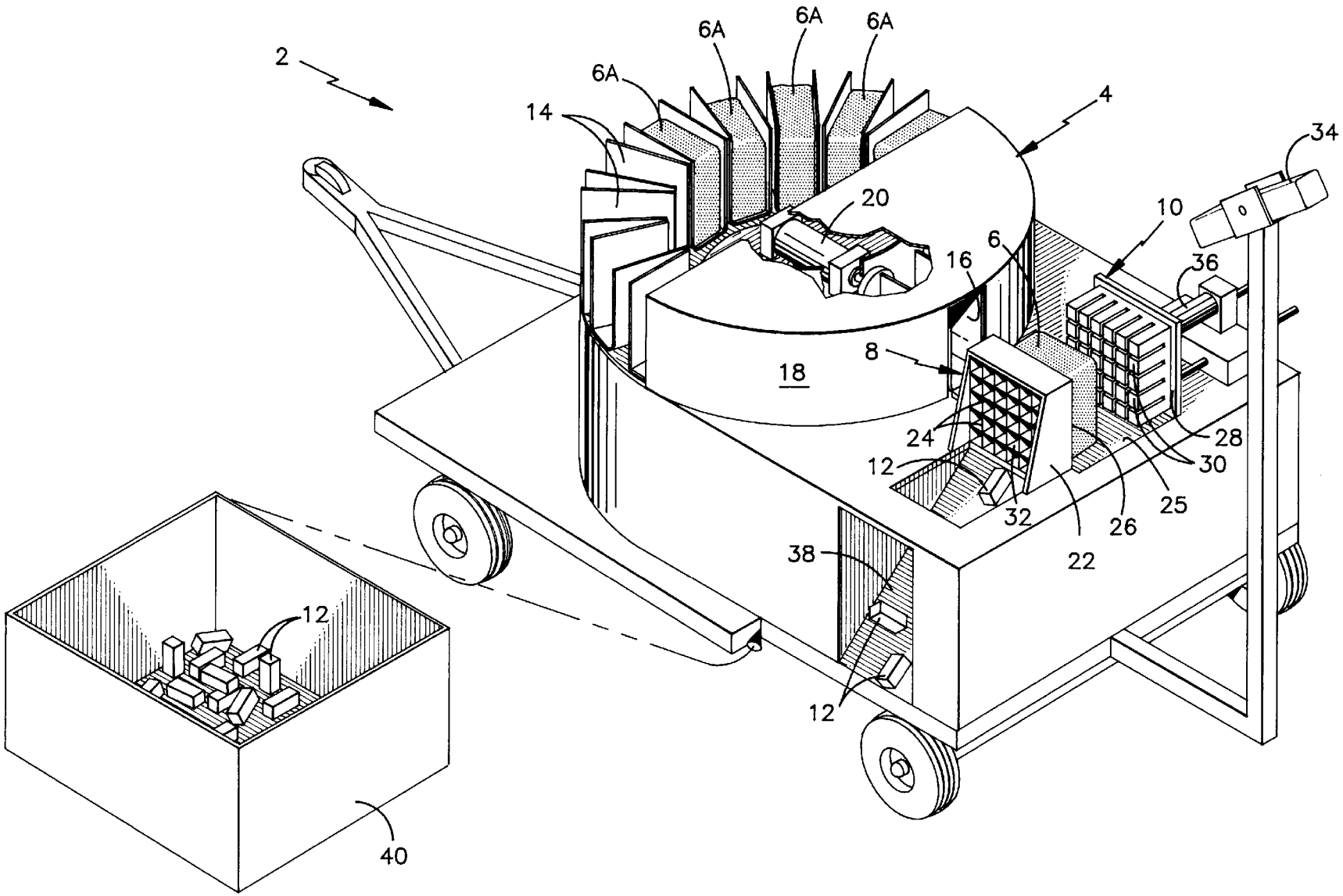
34
36
10
28
30
25
26
22
4
6
32
16
24
8
12
6A
20
18
38
12
6A
6A
6A
14
2
12
40

METHOD AND APPARATUS FOR CUTTING BLOCKS OF SOLID ENERGETIC MATERIALS

TECHNICAL FIELD

The technical field to which this invention pertains is cutting devices particularly remotely controlled cutting devices.

BACKGROUND OF THE INVENTION

Solid energetic materials are used to power rockets as solid rocket propellant motors as well as in the explosives industry. These materials are often manufactured in large batches and, in the case of rocket motors, cast into large blocks or formed in situ in large motor casings. Many times through age or for other reasons such materials must be disposed of or new uses for the materials must be found. Such alternative uses or disposal techniques invariably require that the material be converted into a more manageable size.

In view of the nature of these energetic materials and the dangers associated with handling them it is important to be able not only to reduce the size of the individual blocks of energetic material, but to do it safely and economically. Therefore what is needed in this art is a safe, inexpensive means to form smaller units of energetic material from larger ones.

BRIEF DESCRIPTION OF THE INVENTION

The invention comprises an apparatus for remotely cutting blocks or units of a solid energetic material into smaller blocks or units of material in a safe manner. The apparatus comprises a cutter with one or more blades and a retainer whose face is substantially perpendicular to the blades and spaced apart from them to permit positioning of a block of energetic material between the cutter and the face of the retainer. In addition, the apparatus has a remotely controlled means for causing the blades in the cutter to pass through the block cutting the block into smaller units.

Also disclosed is a method for cutting a large block of energetic material into smaller blocks or units by remotely placing a block of energetic material to be cut between a retainer and a cutter. Then through remote controls, causing the cutting blades to pass through the block thereby cutting the large block into two or more smaller blocks.

BRIEF DESCRIPTION THE DRAWINGS

The drawing is a perspective view with partial cutaway of an apparatus for practicing the present invention.

BEST MODE FOR PRACTICING THE INVENTION

The apparatus of the present invention can be either fixed in one location or constructed as a mobile unit. The mobile unit will permit this invention to be used "in the field" as opposed to shipping the material to be cut to the cutting unit. The embodiment depicted in the FIGURE is a portable unit which may be moved simply by attaching it to a motor vehicle. The FIGURE is intended to be an example of one embodiment of the present invention and is not intended to limit, in any way, the scope of the present invention.

The remote controlled cutter 2 for cutting energetic material has three basic components. There is a remotely controlled means 4 for placing the energetic material 6 in the proper position between a cutter 8 and a retainer 10 so that it may be cut into smaller blocks. Although many methods for positioning these blocks may be used, such as a robotically controlled arm, the preferred method is to use a carousel 4 mounted adjacent to the cutting area. The carousel 4 depicted in the FIGURE contains a plurality of compartments 14 into which blocks 6A of energetic material are placed. The carousel is designed to rotate and index, each compartment 14 in a sequential manner, by means of a hydraulic ram located in the underside of the carousel floor (not shown), such that each compartment 14 in turn is aligned with an opening 16 in the carousel housing 18. (By positioning the hydraulic ram in this way, the chance that some of the energetic material fragments will become entrained in the mechanism is reduced thereby reducing any hazard which would be created). This opening 16 in the carousel housing is situated so as to permit the block 6A of energetic material to be easily moved from the compartment 14 into position between the cutter 8 and the retainer 10. It is also desirable that the carousel 4 have some means for moving the block 6A of energetic material from the carousel compartment 14 into position between the retainer 10 and the cutter 8 by remote control. In the FIGURE, a hydraulic ram 20 is used to push the block 6A out of the compartment 14 aligned with the opening 16 in the carousel housing 18 and into position between the cutter 8 and the retainer 10. Again other techniques could be used to position blocks 6 of energetic material between the cutter and the retainer other than the hydraulic ram disclosed. For instance, having the floor of each of the compartments be slideably fixed on a rail such that when that compartment is indexed to the opening 16 in the carousel housing 18, the floor of the compartment 14 is pulled or otherwise caused to move from the compartment to a position between the cutter 8 and the retainer 10 thereby properly positioning the block 6 of energetic material to be cut.

The second component is the cutter 8. The cutter 8 depicted in the embodiment comprises an outer housing 22 in which a plurality of blades 24 are mounted both vertically and horizontally to the cutting surface 25 creating a number of small openings. The cutting edges 26 of the blades 24 are facing the block 6 of the energetic material to be cut. The edges of the blades 24 closest to the retainer 10 are the cutting edges 26, so that when the block 6A of energetic material is properly positioned and moved so that the cutter 8 and the cutting edges 26 of the blades 24 contact the block 6 of energetic material and pass through it. The cutter 8 is, in this embodiment, fixed relative to the block 6 of energetic material to be cut. However, as is suggested later this cutter could also be moveable if desired. The configuration of the cutter blades 24 in this embodiment is again exemplary and other configurations and number of blades could be adopted depending on the size of the original block of energetic material or the final block size desired after cutting.

The third component is a retainer means 10 positioned so that the block 6, when in position to be cut, will be between the retainer 10 and the cutting edges 26 of the cutting blades 24. In the FIGURE the face of the retainer 28, which is that face which will contact the block 6 of energetic material to be cut, has a number of protrusions 30 which mate with the openings 32 of the cutter 8 and assist in the cutting process.

In view of the remote operation of this cutter 2, it is desirable to have some means for monitoring the operation of the cutter from a remote location. For this purpose a camera 34 is affixed to the cart.

Additionally, a means is required for causing the cutting blades 24 to pass through the block 6 of energetic material.

In the present embodiment the retainer 10 is mounted onto a hydraulic ram 36 which is remotely controlled to move the retainer 10 toward the cutter 8, thereby driving the block 6 of energetic material forcibly into contact with the cutting blades 24 of the cutter 8 and forcing the cutting blades 24 to slice through the block 6 of energetic material cutting it into smaller blocks 12. The protrusions 30, which mate with the openings 32 of the cutter 8, act to push the blocks all the way through the openings 32 and out the back of the cutter 8 onto a chute 38 and into a container 40. These protrusions are formed of nylon from a nylon billet, however, other materials may be used i.e., polyethylene. Due to the nature of the energetic material, it would be preferred that the material chosen would not create sufficient friction during this process to create a hazard to the energetic material being cut. Means other than a hydraulic ram could be used to effect the cutting of the block 6 of energetic material the only requirement would be that it would be capable of applying sufficient force to the block 6 to cause the cutting blades 24 to pass through the block 6 of energetic material.

It is contemplated, and may in certain instances be desirable, to have the retainer 10 stationary and cause the cutter 8 to move to cut the block 6 of energetic material or even for both the cutter 8 and the retainer 10 to move toward each other thereby applying sufficient force to cause the cutting blades 24 of the cutter 8 to pass through the block 6 of energetic material. Further, the cutting blades 24 shown here are stationary with respect to the cutter housing 22 but movable or reciprocating blades may also be used. However, precautions will have to be taken to prevent friction from being created which could present a fire or explosive hazard.

The controls for those units which require operation from a remote position may be operated using conventional control systems. The preferred controls are hydraulically powered and may be operated from a safe distance from the cutting apparatus. These devices are well known to those skilled in the art and would require only standard engineering techniques to apply them to the apparatus of the present invention.

The method of cutting a block 6 of energetic material using the present invention comprises placing blocks 6A of energetic material to be cut into the compartments 14 of the carousel 4. This may be done manually or through a conveyor or some remote controlled robotic arm or other remotely operated device (not shown). The carousel 4 is then caused to rotate until one of the compartments 14, which has a block 6A of energetic material to be cut, is indexed with the opening 16 in the carousel housing 18. The ram 20 is then actuated through a remotely controlled means pushing the block 6A of energetic material out of the compartment 14 into a position between the cutter 8 and the retainer 10. Once the block 6 of energetic material is in position, the ram 20 retracts and the retainer 10 and protrusions 30 are caused to move toward the block 6 of energetic material and the cutter 8. This is done using a second hydraulic ram 36 also remotely controlled. As the retainer 10 moves closer to the cutter 8 it causes the block 6 of energetic material to contact the cutting blades 26 of the cutter 8. The force builds on the block 6 of energetic material as the retainer 10 advances until sufficient force is applied to cause the cutting blades 26 of the cutter 8 to pass through the block 6 of energetic material thereby cutting the block 6 of energetic material into smaller pieces.

Although the term "block" of energetic material is used throughout this specification, it is not intended to limit the configuration of the energetic material to be cut. It may be that under most circumstances the material to be cut is found in block or chunk form, but material in any form may be used.

The present invention described herein offers a practical, safe and economical answer to the problems of managing large blocks of energetic materials such as solid rocket propellants. Such a solution should offer those working with these materials a method of implementing many alternative uses for such materials.

We claim:

1. An apparatus for remotely cutting blocks of solid energetic material into smaller segments comprising:

a cutter having one or more cutting blades;

a retainer having a surface spaced apart from the cutting blades;

a remotely controlled means for positioning a block of energetic material onto a cutting surface and between said cutting blades and said retainer;

a remotely controlled means for causing said cutting blades to pass through the block of energetic material thereby cutting the block into smaller segments;

wherein the means for remotely positioning the block of energetic material between the cutter and the retainer comprises a carousel having a plurality of compartments into which blocks of energetic material are placed, said carousel capable of sequentially positioning each compartment such that at least one compartment is aligned with the cutting surface, and a means for moving said aligned block out of the aligned carousel compartment into position between the cutting blades and the retainer.

2. The apparatus of claim 1 wherein the cutting blades are in the form of a cutting grid in which some of the blades are positioned vertically and some of the blades are positioned horizontally to the cutting surface.

3. The apparatus of claim 2 wherein the surface of the retainer contains one or more protrusions extending outward, which mate with openings in the cutting grid.

4. A method of cutting block explosives into smaller segments comprising:

placing a block of energetic material on a cutting surface between a remotely controlled movable retainer and a cutting grid having one or more cutting blades;

remotely causing the retainer to move toward the cutting grid thereby forcing the block of energetic material against the cutting blades and causing the cutting blades to pass through the block thereby cutting the block into smaller segments.

5. A method of reducing block propellant comprising:

placing a propellant block between a cutting means and a retaining means, wherein the retaining means has protrusions on the surface of the retaining means which is facing the cutting means, said protrusions designed to mate with openings in the cutting means, and remotely causing the block propellant to contact the cutting means and forcing the cutting means to pass through said block propellant.

* * * * *